US005496376A

United States Patent [19]

Falotico et al.

[11] Patent Number: 5,496,376

[45] Date of Patent: Mar. 5, 1996

[54] CARBONATE BUILT LAUNDRY DETERGENT COMPOSITION CONTAINING A DELAYED RELEASE POLYMER

[75] Inventors: Anthony J. Falotico, Doylestown, Pa.; Steven A. Bolkan, Hopewell; Louis R. Mazzola, Mahwah, both of N.J.

[73] Assignee: Church & Dwight Co., Inc., Princeton, N.J.

[21] Appl. No.: 269,217

[22] Filed: Jun. 30, 1994

[51] Int. Cl.[6] ..... C11D 17/00; C11D 1/66; C11D 3/10

[52] U.S. Cl. ..... 252/174; 252/174.13; 252/174.14; 252/174.21; 252/174.23; 252/174.24; 252/DIG. 2

[58] Field of Search ..... 252/174.13, 174.14, 252/174.21, 174.23, 174.24, DIG. 2, 540, 134

[56] References Cited

U.S. PATENT DOCUMENTS

| | | | |
|---|---|---|---|
| 4,265,790 | 5/1981 | Winston et al. | 252/532 |
| 4,464,292 | 8/1984 | Lengyel | 252/532 |
| 4,490,271 | 12/1984 | Spadini et al. | 252/174.23 |
| 4,521,332 | 6/1985 | Milora | 252/527 |
| 4,711,740 | 12/1987 | Carter et al. | 252/174.24 |
| 4,820,441 | 4/1989 | Evans et al. | 252/174.18 |
| 4,849,125 | 7/1989 | Seiter et al. | 252/109 |
| 5,024,782 | 6/1991 | Finn et al. | 252/174.13 |
| 5,332,519 | 7/1994 | Mazzola | 252/174 |

*Primary Examiner*—Margaret Einsmann
*Attorney, Agent, or Firm*—Charles B. Barris

[57] ABSTRACT

A laundry detergent composition, wherein the solids content comprises an active surfactant, at least about 70 wt. % of a water soluble alkaline carbonate, e.g., sodium carbonate, and, a minor amount, for example, about 0.05 to 5 wt. % of a polymeric polycarboxylate, e.g., an acrylic acid polymer, based on the total weight of solids in the composition, the polymeric polycarboxylate being in a form such that its complete release into wash water is delayed to at least about 60 seconds after the complete dissolution of the alkaline carbonate. For example, the polymeric polycarboxylate may be present in slow dissolving granules which also contain a diluent salt such as sodium carbonate and a binder such as a low molecular weight polyethylene glycol. The delayed release of the polymeric polycarboxylate reduces fabric encrustation during washing, i.e., the precipitation of $CaCO_3$ onto fabric surfaces due to the presence of soluble alkaline carbonate.

18 Claims, No Drawings

CARBONATE BUILT LAUNDRY DETERGENT COMPOSITION CONTAINING A DELAYED RELEASE POLYMER

BACKGROUND OF THE INVENTION

1. Field of the Invention

This invention relates to a novel laundry detergent composition having a high water-soluble alkaline carbonate builder content, the use of which results in reduced fabric encrustation due to delayed release of a polymeric polycarboxylate present in the composition.

2. Information Disclosure Statement Including Description of Related Art

The following information is being disclosed under the provisions of 37 CER 1.56, 1.97 and 1.98.

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and the water-soluble alkaline carbonates mentioned previously such as sodium carbonates which may be used in amounts up to 90 wt. % of the composition and which effectively precipitate the calcium ions. However, phosphorus-containing builders have been found to cause a serious problem of eutrophication of lakes, rivers and streams when present in detergent compositions in relatively large amounts, resulting in the passage of laws in several states mandating a drastic reduction in their use. While the use of water-soluble alkaline carbonate builders do not cause eutrophication, they result in the unrelated problem of calcium carbonate precipitation, leading to, for example, fabric encrustation due to the deposition of the calcium carbonate on the fiber surfaces of fabrics which in turn causes fabric to have a stiff hand and gives colored fabrics a faded appearance.

Polymeric polycarboxylates such as polyacrylates are also known in the detergent art as effective sequestering and dispersing agents as well as crystal growth inhibitors. As a result of these properties, the presence of a polymeric polycarboxylate in a high carbonate detergent composition has the known effect of reducing the redeposition of soil and encrustation of calcium carbonate on the surfaces of fabrics washed with such high carbonate detergents. However, a problem connected with the use of such polycarboxylates is that they have limited biodegradability which presents an environmental problem if they are used in relatively large amounts. In the light of these factors, any expedient connected with the use of a satisfactorily small amount of polymeric polycarboxylate which results in an enhanced reduction of fabric encrustation as well as the expected reduction of soil redeposition, is very desirable.

The following prior art references may be considered relevant or material to the invention claimed herein.

U.S. Pat. No. 4,265,790, issued May 5, 1981 to Winston et al., and U.S. Pat. No. 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Pat. No. 4,490,271, issued Dec. 25, 1984 to Spadini et al., discloses detergent compositions comprising an active surfactant, up to 80% of a non-phosphorus detergent builder such as a water-soluble carbonate, and a polyacrylate such as a copolymer of acrylic acid with any of various comonomers.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

SUMMARY OF THE INVENTION

In accordance with this invention a laundry detergent composition is provided wherein the solids content comprises an active surfactant, at least about 70 wt. % of a water-soluble alkaline carbonate builder, and a minor amount, e.g., about 0.05 to 5 wt. % of a polymeric polycarboxylate, based on the total weight of solids in the composition, the polymeric polycarboxylate being in a form such that it is released in the wash water at least about 60 seconds after the complete dissolution of the soluble carbonate builder under normal conditions of washing. The polymeric polycarboxylate may be present, for example, in agglomerated granules unagglomerated with the particles of said surfactant and soluble carbonate builder and having a particle size range larger than that of polymeric polycarboxylate conventionally employed in detergent compositions and which may contain a diluent salt and organic binder or be surface coated with a slow dissolving substance. Either or both of these features cause the granules containing the polycarboxylate to dissolve more slowly than conventional polycarboxylate powder, providing for a delayed release of polycarboxylate into the wash water with respect to the soluble carbonate. Since the granules may contain another polymer as organic binder which is not a polymeric polycarboxylate as explained hereinafter, the polymeric polycarboxylate intended to reduce fabric encrustation as well as soil redeposition will be referred to as the "primary polymer".

It has been found that high carbonate detergent compositions containing a polymeric polycarboxylate (primary polymer) present in slow-dissolving granules causes a smaller amount of fabric encrustation than does a similar composition containing an equivalent amount of polycarboxylate in the form of a conventional powder. The term "polymeric polycarboxylate" includes homopolymers of monoethylenically unsaturated carboxylic acids and copolymers of such acids as hereinafter defined.

Incorporation of the primary polymer in the slow dissolving granules in the foregoing laundry detergent composition containing carbonate ions is intended to minimize negative interactions that will occur between the precipitation of calcium carbonate and the surfaces of the fabric being cleaned. For example, the composition is capable of providing excellent cleaning and whitening of fabrics while avoiding the problem of eutrophication which occurs when a substantial amount of a phosphorous containing builder such as STPP is present in the composition, and while minimizing the problem of fabric encrustation often present when the composition contains a large amount of carbonate builder.

DETAILED DESCRIPTION OF THE INVENTION

The water-soluble alkaline carbonate in the detergent composition may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. %, preferably about 75 to 85 wt. %. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

In general, the wash water with which the detergent composition is used contains a calcium hardness of for example, about 10 to 350 ppm expressed as $CaCO_3$, and a Ca/Mg molar ratio of, for example, about 5/1 to 2/1 may be present.

The active surfactant component in the detergent composition may be, for example, one or more of many suitable synthetic detergent active compounds which are commercially available and described in the literature, e.g., in "Surface Active Agents and Detergents", Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$-$C_{18}$, preferably $C_{12}$-$C_{16}$, alkyl groups and, if ethoxylated, on average about 1–15, preferably 3–12 moles of ethylene oxide (EO) per mole of alcohol, and sulfated ethoxylated alkylphenols with $C_8$-$C_{16}$ alkyl groups, preferably $C_8$-$C_9$ alkyl groups, and on average from 4–12 moles of EO per mole of alkyl phenol.

The preferred class of anionic surfactants are the sulfated ethoxylated linear alcohols, such as the $C_{12}$-$C_{16}$ alcohols ethoxylated with an average of from about 1 to about 12 moles of ethylene oxide per mole of alcohol. A most preferred sulfated ethoxylated detergent is made by sulfating a $C_{12}$-$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$-$C_{18}$, preferably $C_{12}$-$C_{16}$, alkyl groups and on average about 1–15, preferably 3–12 moles of ethylene oxide (EO) per mole of alcohol, and ethoxylated alkylphenols with $C_8$-$C_{16}$ alkyl groups, preferably $C_8$-$C_9$ alkyl groups, and on average about 4-12 moles of EO per mole of alkyl phenol.

The preferred class of nonionic surfactants are the ethoxylated linear alcohols, such as the $C_{12}$-$C_{16}$ alcohols ethoxylated with an average of from about 1 to about 12 moles of ethylene oxide per mole of alcohol. A most preferred nonionic detergent is a $C_{12}$-$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

The polymeric polycarboxylate, i.e., primary polymer, may be, for example, a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either relatively non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

The primary polymer should have a number average molecular weight of, for example about 1000 to 10,000, preferably about 2000 to 5000. To ensure substantial water solubility, the primary polymer is completely or partially neutralized, e.g., with alkali metal ions, preferably sodium ions.

Mixtures of any of the foregoing polymers may also be used as the primary polymer.

The primary polymer is present in the detergent composition in an amount, for example, of about 0.05 to 5 wt. %, preferably about 0.1 to 2 wt. %, based on the weight of the total solids.

The granules comprising the primary polymer contemplated under this invention may be prepared for example, by first compacting a conventional powdered primary polymer which may contain a minor amount, e.g., about 0 to 10 wt. % of water, present as a result of the process of preparing the primary polymer and/or natural hygroscopicity, or which may be added as pure water or as an aqueous solution of the same primary polymer as that making up the initial powder or of a different primary polymer contemplated under this invention. The compacted polymer may then be broken up to obtain granules having a desired particle size range and which, exclusive of moisture, are comprised substantially of primary polymer, i.e., do not contain any non-carboxylate polymeric binders or diluent salts as disclosed hereinafter. However, for the purpose of improving the integrity of the granules, i.e., resistance to breaking up into finer particles, and preventing the primary polymer from dissolving too readily in the wash water, such granules are preferably in the form of a preblend which contains, in addition to the polymeric polycarboxylate, a diluent salt. Such salt may be any water soluble salt which acts an absorbent and does not interfere with the function of the granules in reducing fabric encrustation, e.g., water soluble salts of sodium, potassium, magnesium and strontium, such as sodium and potassium carbonates, bicarbonates, chlorides, sulfates and nitrates, magnesium sulfate, magnesium chloride, magnesium nitrate, magnesium acetate, dibasic magnesium citrate, strontium chloride, strontium acetate and strontium nitrate. In this connection, it has been found that the presence of magnesium and strontium salts in a high carbonate detergent composition contribute to a reduction in fabric encrustation independent of their presence in the delayed release granules of this invention; see application Ser. No. 08/136,394, filed Oct. 13, 1993, with regard to magnesium salts and application Ser. No. 08/169,772, filed Dec. 17, 1993, with regard to strontium salts. However, the preferred diluent salts are sodium carbonate which is the most widely used salt in a carbonate-built detergent compositions, and sodium chloride because of its cheapness and availability.

When a diluent salt is utilized in the preblend granules, it may be present in an amount, for example, of about 15 to 60 wt. %, preferably about 30 to 50 wt. %, based on the total weight of preblend granules.

In addition to a polymeric polycarboxylate, i.e., primary polymer, and a diluent salt when present, the delayed release granules may also optionally contain an additional component which acts as a binder for the other components, i.e., preserves or increases further the integrity of the granules by binding the polymeric polycarboxylate primary polymer particles and the diluent salt particles more closely, and which may also act independently to slow the dissolution of the primary polymer in the wash water. The binder is in most cases an organic substance having a melting or softening point of at least about 45° C. and the chemical structure of which includes hydrophobic and lipophobic groups such that the hydrophobic-lipophobic balance (HLB) is in the range for example of about 2 to 20, preferably about 4 to 12. The binder may be, for example, a water soluble polymer, a non-ionic or anionic surfactant such as any of those delineated hereinbefore, or a water soluble partially or fully neutralized $C_{12}$ to $C_{18}$ fatty acid salt.

Water soluble polymers which can be utilized as the binder are for example, water soluble synthetic and naturally derived polymers such as low molecular weight polyethylene glycols, e.g., Carbowaxes, having a number average molecular weight for example, of about 1000 to 10,000, polyvinyl alcohols, partially hydrolized polyvinyl acetates, polyvinyl pyrrolidone, water soluble cellulose ethers such as methyl cellulose and sodium carboxymethyl cellulose, and soluble starches and natural gums and their derivatives. In the preparation of the delayed release granules, a polymeric polycarboxylate such as any of those disclosed previously as possible primary polymers, may be used in the form of an aqueous solution to bind particles of primary polymer powder and, if used, particles of the diluent salt, as described more fully hereinafter. Such polymeric polycarboxylate in the aqueous solution may be the same or different from the polymeric polycarboxylate of the powder. In either case, however, the polymeric polycarboxylate in the aqueous solution and that making up the dry powder combine to form a single primary polymer component in the final granules, and there would not be any identifiable separate binder component in the granules.

Fully or partially neutralized salts of $C_{12}$ to $C_{18}$ fatty acids which may be employed as the binder are water soluble salts, e.g., sodium and potassium salts, of lauric, myristic, palmitic, oleic, and stearic acid, e.g., alkali metal stearates such as sodium stearate. The unneutralized acids may also be used in which case they may become partially neutralized by reaction with any basic diluent salt which may be present, such as sodium carbonate.

The preferred binders are low molecular weight polyethylene glycols, solid "Plurafac" surfactants (oxyalkylated primary aliphatic alcohols), and sodium stearate.

If used, the binder may be present in the delayed release preblend granules in an amount, for example of about 5 to 50 wt. %, preferably about 10 to 30 wt. %, based on the total weight of preblend granules.

Alternative to the use of an organic binder as previously described, the composition comprising a primary polymer and a diluent salt may be formed into free-flowing granules which are coated with a material which slows the dissolution of polymer into solution. Coating materials which may be used are for example, water soluble materials capable of forming continuous films by applying an aqueous solution to a surface and drying, e.g., inorganic materials such as sodium and potassium silicates and tetrapotassium pyrophosphate, and organic water-soluble materials such as Carbowax and Plurafac solid surfactants, and materials which may be applied in the molten state including stearic acid, Carbowax and Plurafac solid surfactants. When the granules are coated as described, the coating material may comprise, for example, about 2 to 30 wt. %, preferably about 5 to 20 wt. %, based on the total weight of the granules.

The granules of this invention comprising primary polymer generally have a particle size range of about 8 to 30 U.S. mesh size, preferably about 12 to 20 U.S. mesh size.

As stated, the effectiveness of the primary polymer-containing granules of this invention depend on a significant delayed release of the primary polymer into the solution phase of the wash water, i.e., the complete dissolution of the primary polymer should be delayed until, for example, at least about 60 seconds after the complete dissolution of the soluble carbonate in the detergent, preferably about 60 to 200 seconds and most preferably about 130 to 160 seconds after the complete dissolution of the soluble carbonate. Since the rates of dissolution in water of the soluble carbonates contemplated for use in the detergent composition are generally well-known under various conditions, the delayed release properties of the primary polymer in the granules are correlatable with the rate of complete dissolution in water of the primary polymer granules under controlled standard conditions as indicated by the time elapsed before the conductance reaches a constant maximum. Conditions of dissolution which have been found satisfactory for this purpose are the dissolution of granules containing 0.50 gram of primary polymer in one liter of water at 20° C. with a degree of stirring to cause the formation of a vortex about 5 cm. in diameter. Under these conditions, the conductance maximum should be reached, for example, within a range of about 60 to 200 seconds, preferably about 130 to 160 seconds.

The primary polymer and diluent salt containing granules may be prepared by various methods known in the art. Thus the dry diluent salt may be blended with an aqueous solution of the primary polymer and, if used, the binder to form agglomerates which may be dried and screened to obtain the desired particle size distribution. Alternatively, the diluent salt may be blended with powdered primary polymer and, if used, binder and the resulting dry blend mixed with water to form agglomerates which are dried and screened. Moreover, the diluent salt may also be blended with either the primary polymer or the binder and the resulting blend mixed with an aqueous solution of the component which was not dry blended to form agglomerates which are screened and dried. Finally, the primary polymer, diluent salt and binder, if used, may be dry blended in the presence of a minor amount of water and compacted, e.g., with a piston and cylinder mechanism to form tablets which are screened to the desired particle size distribution.

In the case of coated granules, the agglomerates comprising primary polymer and diluent salt are formed using any of the techniques described previously, and are then treated with a mixture of the coating component, e.g., sodium silicate, and water. The coated agglomerates are then dried and screened to produce a freeflowing "polymer preblend".

The detergent composition of this invention is generally in the form of a dry-appearing powder containing the delayed release granules, in which case the weight percentages of the various components mentioned previously are approximately based on the weight of the total composition. However, such dry appearing powder generally contains water in an amount, for example, of about 1 to 12 wt. %, preferably about 2 to 10 wt. % based on the weight of the total composition.

The laundry detergent compositions of this invention may also contain various adjuvants common to detergent formulations such as brighteners, enzymes, carboxymethylcellulose, perfumes, dyes and peroxide generating persalts.

The following examples further illustrate the invention. In the examples involving values of conductance maximum, which correlate with the fabric encrustation caused by the employment of a carbonate built detergent composition, such values were determined as described previously.

EXAMPLES 1 AND 2 AND COMPARATIVE EXAMPLES A AND B

These examples illustrate the determination of conductance maximums in seconds of compositions in various forms containing a constant amount of a specific primary polymer, the conductance maximum being the time in seconds for a stirred aqueous suspension of each composition to reach a constant maximum conductivity under controlled conditions. In each example, the primary polymer was "Acusol 912 N" made by Rohm and Haas, this being of a 50–80% neutralized mixture of 50 wt. % "445 polymer" which is polyacrylic acid having a number average molecular weight of about 4500, and 50 wt. % of "Copolymer 480" which is a copolymer of acrylic acid and methacrylic acid having a number average molecular weight of about 4500. The primary polymer becomes completely neutralized on contact with sodium carbonate in the presence of water. The primary polymer-containing composition in each example is characterized in the following description wherein all parts are by weight.

In Example 1, a binder consisting of 1.8 parts of "Carbowax 3350" sold by Union Carbide, which is a polyethylene glycol having a number average molecular weight of about 3350, was dissolved in water and the resulting solution was mixed with 18.4 parts of a 45 wt. % of primary polymer in water. Using a Hobart Kitchen-Aid mixer, the solution was blended with 70.9 parts of sodium carbonate. The resulting agglomerates were dried and screened to obtain freeflowing granules of a polymer preblend having a particle size range of about 12 to 20 U.S. mesh size.

In Example 2, 70.9 parts of sodium carbonate were blended with 10.9 parts of a liquid primary polymer containing 45 wt. % solids using a Hobart Kitchen-Aid mixer to form agglomerates. This was followed by the addition of 14.2 parts of a liquid sodium silicate containing 37 wt. % solids to provide a top coating of sodium silicate. A total of 4 parts of free water were used to dilute the aforementioned liquids. The agglomerates formed were dried and screened to provide freeflowing coated granules having a particle size range of about 12 to 30 U.S. mesh size.

In comparative Example A, the primary polymer-containing composition was a commercially available dry powdered polymer which had a particle size such that at least 90% passed through a 100 U.S. mesh screen.

In Comparative Example B, the primary polymer-containing composition was a commercially available dispersion in water of 45 wt. % of the primary polymer.

In each example, an amount of sample containing 0.5 gram of primary polymer was added to one liter of water at 20° C. and while the mixture was stirred to form a vortex about 5 cm. in diameter, solution conductance was measured with an SYI Model 30 conductivity meter equipped with 1 cm. platinum electrodes. The conductance maximum is the number of seconds of stirring which were necessary before the conductance reached a constant maximum, and is correlatable with the rate of release of primary polymer into the wash water under conventional washing conditions. The weight of each polymer-containing sample and for comparison, sodium carbonate, and its conductance maximum is shown in Table I.

TABLE I

| Example | Weight of Sample, grams | Conductance Maximum, seconds |
|---|---|---|
| 1 | 6.038 | 190 |
| 2 | 10.2 | 220 |
| A | 0.5 | 120 |
| B | 1.11 | 120 |
| Sodium Carbonate | 5.00 | 60 |

The results of Table I show that the conductance maximums and therefore the delayed release properties of the granules of Examples 1 and 2 were significantly greater than those of the conventional forms of the primary polymer of Comparative Examples A and B.

EXAMPLE 3

This example illustrates the results of an encrustation test carried out on the primary polymer-containing granules of Example 1.

A laundry detergent composition was prepared comprising 80 wt. % of sodium carbonate, 0.5 wt. % of sodium bicarbonate, an active surfactant consisting of 6.0 wt. % of the sodium salt of a sulfated $C_{12}$-$C_{15}$ alcohol (anionic surfactant), 3.2 wt. % of a $C_{12}$-$C_{15}$ alcohol ethoxylated with 3 moles of ethylene oxide per mole of alcohol (nonionic surfactant), 7.4 wt. % of the polymer preblend granules of Example 1 and 2.9 wt. % of water. The detergent composition was tested for fabric encrustation by repeated washing of cotton fabric at 35° C. in wash water having a calcium hardness of about 350 ppm expressed as calcium carbonate and a Ca/Mg molar ratio of about 2/1. In carrying out the test, four 25.4 cm.×25.4 cm., 100% black cotton fabric swatches along with 0.907 kg. of ballast were washed for 12 min. with 113.4g of the detergent composition being tested such that the wash liquor contained about 0.162 wt. % of detergent. After five cycles of washing, 2.00–4.00g of the calcium carbonate encrusted fabrics were extracted in 100 ml. of 0.2N hydrochloric acid for 30 min. and a 2.0–4.0 ml. aliquot is analyzed for hardness by the EDTA titration method. The encrustation expressed as mg. calcium carbonate per gram of fabric, was found to be 120.

EXAMPLE 4

The procedure of Example 3 was followed except that in the preparation of the primary polymer preblend granules, 40 parts of sodium stearate as binder were substituted for the Carbowax 3350. The encrustation was found to be 115 mg. of $CaCO_3$ per gram of fabric.

Comparative Example C

As a control, the procedure of Example 3 was followed except that in place of the primary polymer preblend granules, 1.5 wt. % of conventional powdered primary polymer was present in the detergent composition. The encrustation was found to be 160 mg. of $CaCO_3$ per gram of fabric.

The results of Examples 3 and 4 and Comparative Example C show that employment of the delayed release granules of this invention, as illustrated in Examples 3 and 4, results in a lower level of encrustation than employment of an equivalent amount of conventional powdered primary polymer, illustrated in Comparative Example C.

We claim:

1. A laundry detergent composition wherein the solids content comprises an active surfactant, at least about 70 wt. % of a builder consisting of a water-soluble alkaline carbonate, and about 0.05 to 5 wt. % of a polymeric polycarboxylate, based on the total weight of solids in the composition, said composition containing delayed release agglomerated granules consisting essentially of said polymeric polycarboxylate and optionally a diluent salt and binder, and having a particle size distribution within the range of about 8 to 30 U.S. mesh size such that the compete release of said polymeric polycarboxylate into wash water under normal washing conditions is delayed to at least about 60 seconds after the complete dissolution of said alkaline carbonate builder.

2. The composition of claim 1 wherein said particle size range is about 12 to 20 U.S. mesh size.

3. The composition of claim 1 where said granules contain a diluent salt.

4. The composition of claim 3 wherein said diluent salt is sodium carbonate or sodium chloride.

5. The composition of claim 3 wherein said granules also contain an organic binder having a melting or softening point of at least 45° C. and a hydrophobic-lipophobic balance (HLB) of about 2 to 20.

6. The composition of claim 5 wherein said binder is a low molecular weight polyethylene glycol or sodium stearate.

7. The composition of claim 5 wherein said granules comprise in addition to said polymeric polycarboxylate, about 15 to 60 wt. % of said diluent salt, and about 5 to 50 wt. % of said binder, based on the weight of the granules.

8. The composition of claim 5 wherein said granules comprise about 30 to 50 wt. % of said diluent salt, and about 10 to 30 wt. % of said binder.

9. The composition of claim 1 wherein said granules are further coated with a material which dissolves slowly in water.

10. The composition of claim 9 wherein said material is sodium silicate.

11. The composition of claim 1 wherein said alkaline carbonate comprises an alkali metal carbonate.

12. The composition of claim 11 wherein said alkali metal carbonate comprises sodium carbonate.

13. The composition of claim 12 wherein said alkali metal carbonate comprises about 75 to 80 wt. % of sodium carbonate and about 0.1 to 15 wt. % of sodium bicarbonate.

14. The composition of claim 1 wherein said active surfactant comprises an anionic surfactant and a nonionic surfactant.

15. The composition of claim 14 wherein said anionic surfactant is an alkali metal salt of sulfated linear $C_{12}$-$C_{16}$ alcohols ethoxylated with an average of 1 to 12 moles of ethylene oxide per mole of alcohol and is present in an amount of about 4 to 14 wt. %, and said nonionic surfactant consists of $C_{12}$-$C_{16}$ linear alcohols ethoxylated with an average of 1 to 12 moles of ethylene oxide per mole of alcohol and is present in an amount of about 2 to 8 wt. % based on the weight of total solids.

16. The composition of claim 1 wherein said polymeric polycarboxylate is an acrylic acid polymer.

17. The composition of claim 1 in the form of a dry-appearing powder containing about 1 to 12 wt. % of water.

18. A process comprising washing a fabric with the composition of claim 1.

* * * * *